US005888153A

United States Patent [19]

Masin

[11] Patent Number: 5,888,153

[45] Date of Patent: Mar. 30, 1999

[54] PORTABLE SHOT TARGET ASSEMBLY

[75] Inventor: James Steven Masin, Bradford, Canada

[73] Assignee: Sporting Tech 99 Inc., Richmond Hill, Canada

[21] Appl. No.: 722,851

[22] Filed: Sep. 26, 1996

[51] Int. Cl.[6] ..... A63B 69/00

[52] U.S. Cl. ..... 473/446; 273/400; 273/392

[58] Field of Search ..... 273/400, 392

[56] References Cited

U.S. PATENT DOCUMENTS

| | | | |
|---|---|---|---|
| 4,245,843 | 1/1981 | Griggs | 273/393 |
| 4,842,283 | 6/1989 | LeBel et al. | 473/478 |

FOREIGN PATENT DOCUMENTS

| | | | |
|---|---|---|---|
| 1446465 | 9/1980 | France | 273/400 |
| 1771777 | 10/1992 | Russian Federation | 273/400 |

*Primary Examiner*—Mark S. Graham

*Attorney, Agent, or Firm*—Riches, McKenzie & Herbert

[57] ABSTRACT

In practising various sports such as hockey, it is known to provide a target in a desired position such that the shooter strikes or otherwise directs a projectile at the target. In this invention, the target is portable and can be connected to a fixed object such as the frame of a hockey net. The target is a band of steel or other sturdy material and of any desired shape. A pocket is connected to the perimeter of the target for catching a hockey puck, ball or other object which is directed through the perimeter of the target. A spring is, at one end, connected to the target and, at its opposite end, connected to a clamping device such that the target, spring and clamping device, can be connected to a fixed object such as the goal post or crossbar of a hockey net. The shot target assembly can be easily connected to and removed from a wide variety of objects. The spring can absorb any impact caused by a projectile hitting the target without displacing the shot target assembly and without causing damage to the target.

21 Claims, 4 Drawing Sheets

PORTABLE SHOT TARGET ASSEMBLY

This invention relates to a portable shot target assembly and more particularly to a portable shot target assembly which may be connected to a stationary object to enable a person to practise his or her shot by directing a puck, ball or other object at the target.

It is important in many sports, such as ice, field, floor and roller hockey, ringuette, soccer and the like, to be able to strike an object with a high degree of accuracy at a desired part of the opponent's net so as to score a goal. It is similarly desirable to practise one's aim in throwing an object at a target in sports such as baseball and cricket.

In the case of sports involving scoring into the opponent's net, it is known to place targets in the vertical plane of the front of a net through various means.

For example, a sheet of material such as nylon, plastic and the like can be positioned in the vertical plane of the front of a net. The sheet can either have pre-cut target holes or the player can cut out the target holes. The disadvantages of this configuration include the lack of flexibility available to the player in choosing a new location for a target. The sheet may also not be durable enough to withstand the repeated impact of a projectile travelling at high speeds. Furthermore, the sheet cannot be used with a goaltender in position because the goaltender cannot move anywhere behind the plane of the front of the net without coming into contact with the sheet.

Another type of target is made of plastic, has a removable insert for fitting into the target area and includes attachment devices requiring the use of tools to install a series of nuts, washers and bolts. In one category of such targets, the insert is made of a breakable material. In another category of these targets, the insert is a light foam or sponge-like material which becomes disengaged from the target upon the target being successfully hit. These products have several disadvantages. First, if the target insert is made of a breakable material, the debris from the insert shatters and creates a mess which is time consuming to clean and is a safety hazard. Second, targets which are made of plastic have a durability problem. In outdoor applications in cold weather or in indoor arenas used for ice hockey, the cold temperatures can cause the target frames to easily break when hit by the puck or hockey ball. Third, these targets must be mounted with the use of tools. This usually cannot be done without an adult's assistance and, even in such case, is difficult, particularly so in cold temperatures. Fourth, the target's location on the net or other structure cannot be easily changed without removing the target, which again involves the use of tools and takes time which could otherwise be spent practising. Fifth, the foam or sponge-like inserts become disfigured with repeated use such that they may no longer stay inside the target without popping out.

The present invention provides a target assembly which is portable, durable and easy to mount, relocate and use.

The present invention in one aspect provides a portable shot target assembly comprising a target, means for connecting the target to a fixed object and means for absorbing shock from impact on the target.

The target may be of any desired shape and may be defined by a closed band of rigid material such as steel. For example, a target which is similar in shape and construction to a common basketball hoop would be suitable. A pocket may also be connected to the perimeter of the target for catching projectiles which pass through the perimeter of the target. The pocket may be constructed of any material which is capable of slowing the projectile down and catching the projectile without breaking. A sheet of mesh which is similar to the mesh which is connected to the frame of a hockey net or the mesh which is connected to the perimeter of a basketball hoop would be suitable for this purpose.

The means for absorbing shock from impact on the target may be a spring which is connected at one end to the target and is connected at its other end to the means for connecting the target to the fixed object. The spring may be connected to the target and to the connecting means in a number of ways. For example, the spring may be welded to the target or the connecting means. Alternatively, the spring may, at one end, be threaded on to a threaded bolt which is attached to the target. If the threaded bolt slightly tapers from its point of attachment to the target, the spring can be even more tightly secured to the bolt. At its other end, the spring may be threaded on to a second threaded bolt which is attached to the means for connecting the target to a fixed object. Again, the second threaded bolt may slightly taper from its point of attachment to the connecting means for a more secure connection of the spring and bolt.

The means for connecting the target to a fixed object may be means for clamping the target to the fixed object. An outer bracket for fitting around the fixed object is connected at one end to the shock absorbing means. An inner bracket having grooves on its inner surface for gripping the fixed object is located within the outer bracket.

The means for fastening the outer and inner brackets to the fixed object may be as follows. A bolt head extends from the outer surface of the inner bracket and a T-screw passes through the outer bracket and screws into the upper surface of the bolt head. A set screw which screws into a side surface of the bolt head prevents the T-screw from becoming detached from the inner bracket.

A flexible insert may be fitted around the fixed object in situations where the fixed object is too thin for a secure fit between the clamping means and the fixed object. The flexible insert may be constructed of any material such as rubber which is flexible enough to fit around the fixed object and securely grip the fixed object. For example, if the fixed object is circular in cross-section, the flexible insert would have a convex outer surface and a concave inner surface. A sliding handle on the T-screw allows it to be tightened and loosened by hand. When the T-screw is tightened, the inner bracket and the outer bracket securely grip the fixed object such that the shot target assembly is maintained in position. When the shot target assembly is in place on the frame of a hockey net, for instance, the target will be positioned in the vertical plane at the front of the net.

In the shot target assembly of this invention, a person can connect the shot target assembly to a wide variety of fixed objects, strike or otherwise direct a projectile at the target and, when finished, easily determine his or her success ratio by counting the number of projectiles which have been caught in the pocket which is connected to the target.

The invention, as exemplified by a preferred embodiment, is described with reference to the drawings in which.

Figure 1:
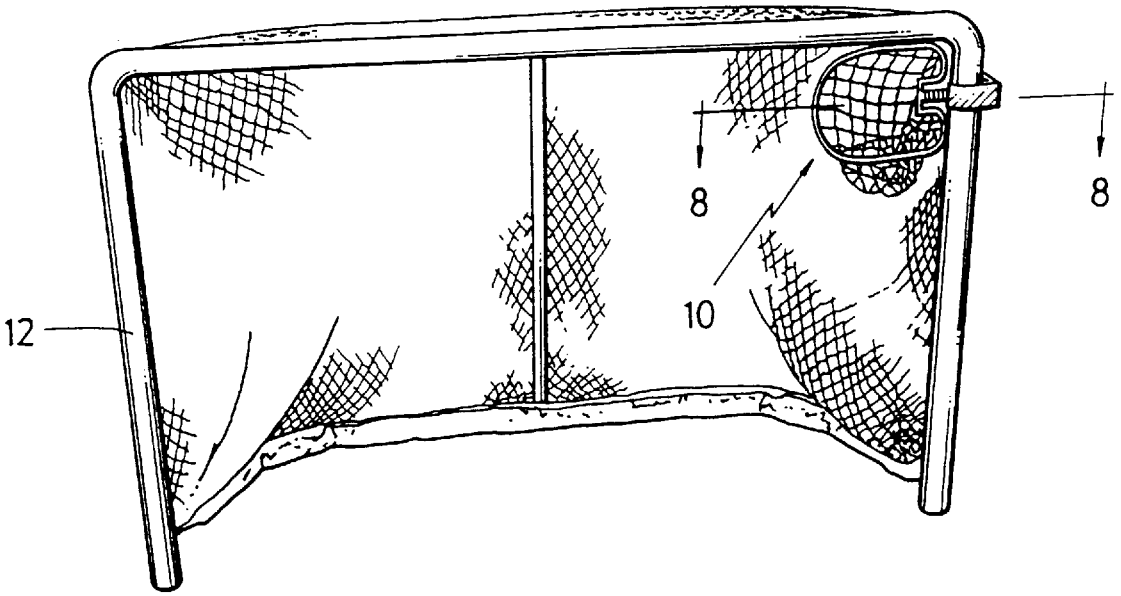
FIG. 1 is a perspective view of a preferred embodiment of the portable shot target assembly of the invention connected to a goalpost of a hockey net.
Figure 2:
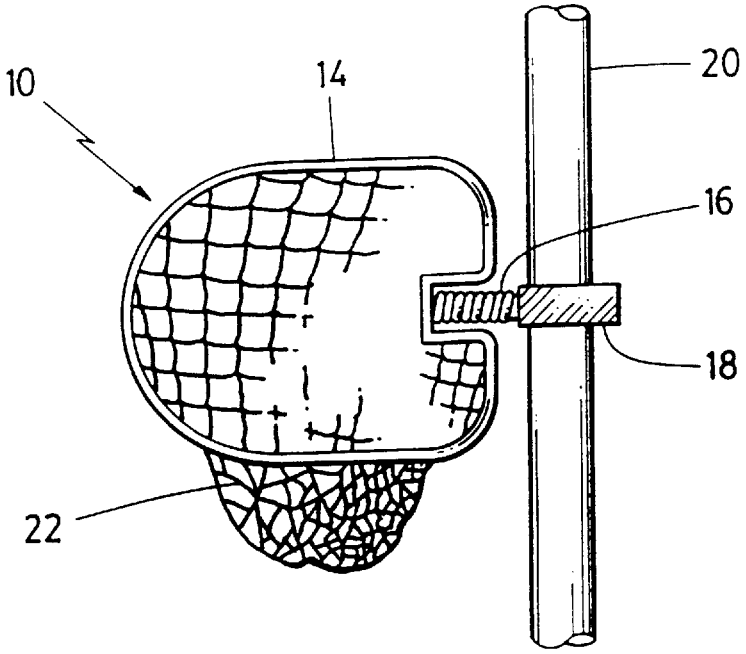
FIG. 2 is an expanded perspective view of the portable shot target assembly shown in FIG. 1.

Referring to FIGS. 1 and 2, there is shown a portable shot target assembly 10 for use with a hockey net 12 having a target 14.

Although in FIGS. 1 and 2, the target is oval-shaped, any shape may be used. The target may be made of a closed band of rigid material. The band may be made of a metal such as steel. A target which is similar to a basketball hoop would be suitable. A spring 16 is connected at one end to the target and at its opposite end to a clamping device 18. The spring may be connected to the target and to the clamping device by any suitable means such as welding. One type of connection of the spring to the target and to the clamping device is shown in greater detail in FIG. 8. Returning to FIGS. 1 and 2, the clamping device is connected to a goal post 20 of the hockey net. The hockey net which is shown in FIG. 1 is of the type which would be used in professional hockey matches. A sheet of mesh 22 is attached to the perimeter of the target to form a pocket for catching projectiles which are struck through the perimeter of the target.

Figure 3:
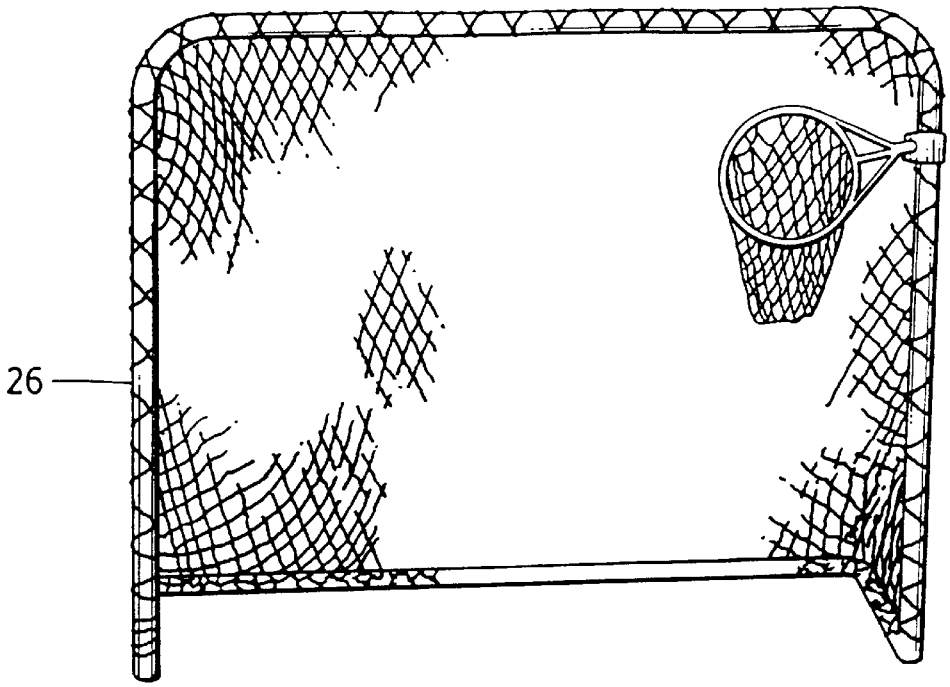
FIG. 3 is a perspective view of an alternative embodiment showing a differently shaped target than in FIG. 1 and connected to a goalpost of a different type of hockey net than that shown in FIG. 1.
Figure 4:
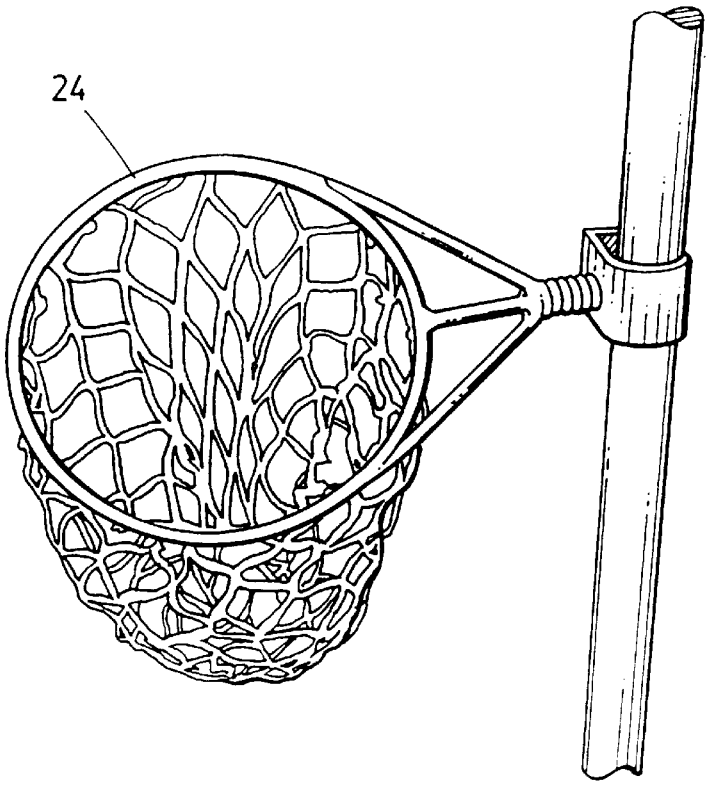
FIG. 4 is an expanded perspective view of the portable shot target assembly shown in FIG. 3.

FIGS. 3 and 4 depict a circular target 24 attached to a hockey net 26 which is less expensive than the professional hockey net depicted in FIG. 1 and would be more likely to be used for recreational purposes.

Figure 5:
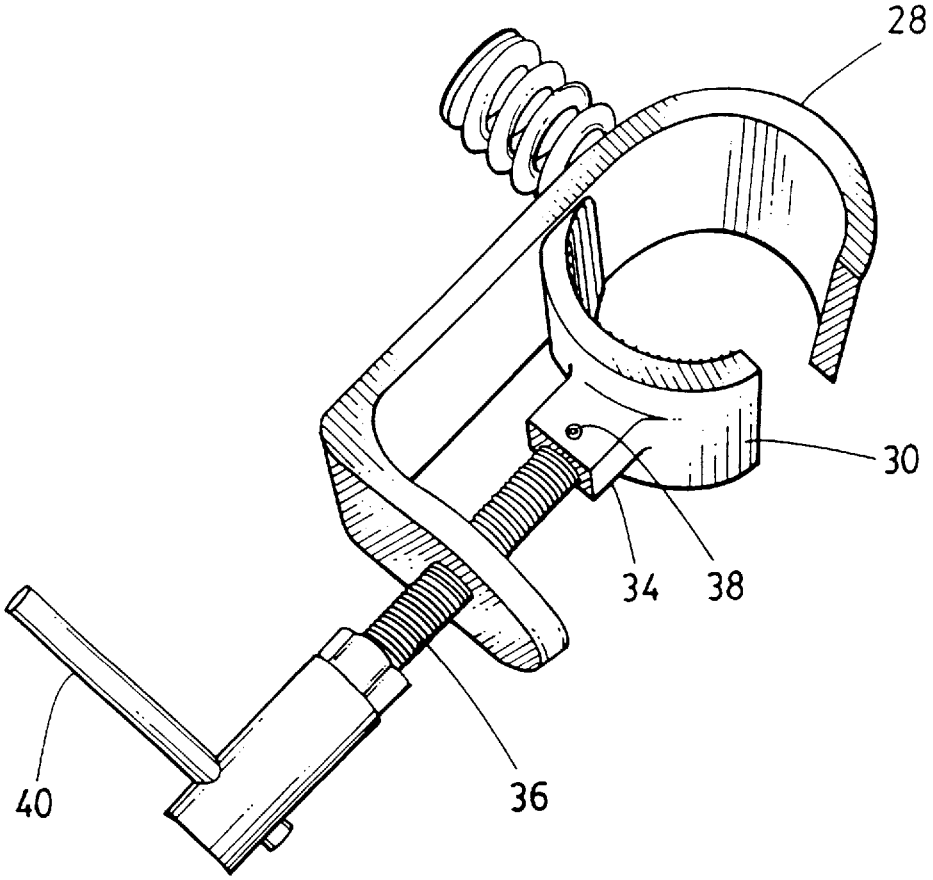
FIG. 5 is a perspective view of the clamping means of the preferred embodiment of the present invention.
Figure 6:
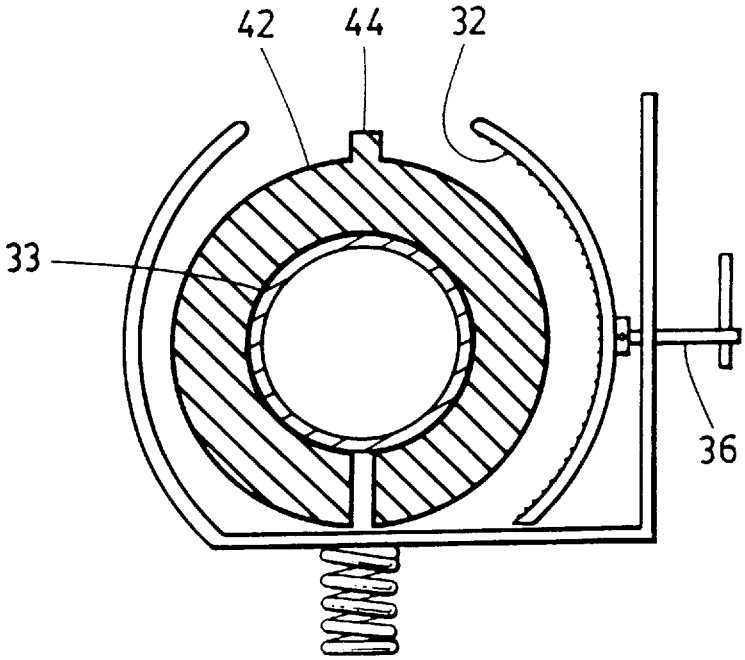
FIG. 6 is a top view of the clamping means.

Referring to FIGS. 5 and 6, a preferred means for connecting the target to a fixed object is shown. An outer bracket 28 may be made of steel or a variety of other sturdy materials. An inner bracket 30, for applying pressure on the fixed object 33, is contained within the outer bracket. Grooves 32 on the inner surface of the inner bracket securely grip the inner bracket to the fixed object. A bolt head 34 extends from the outer surface of the inner bracket. A T-screw 36 passes through the outer bracket and screws into the upper surface of the bolt head such that the tightening of the T-screw causes the outer bracket and inner bracket to tightly grip the fixed object. A set screw 38 prevents the T-screw from becoming detached from the bolt head. A sliding handle 40 allows the T-screw to be tightened and loosened by hand. An optional flexible insert 42 made of rubber or other flexible material may be placed around the fixed object in situations where the fixed object is otherwise too thin to permit a secure fit between the clamping means and the fixed object. Ribbing 44 on the flexible insert prevents the insert from breaking when the insert is connected to or removed from the fixed object. The clamping means can accordingly fit a wide variety of sizes of fixed objects.

Figure 7:
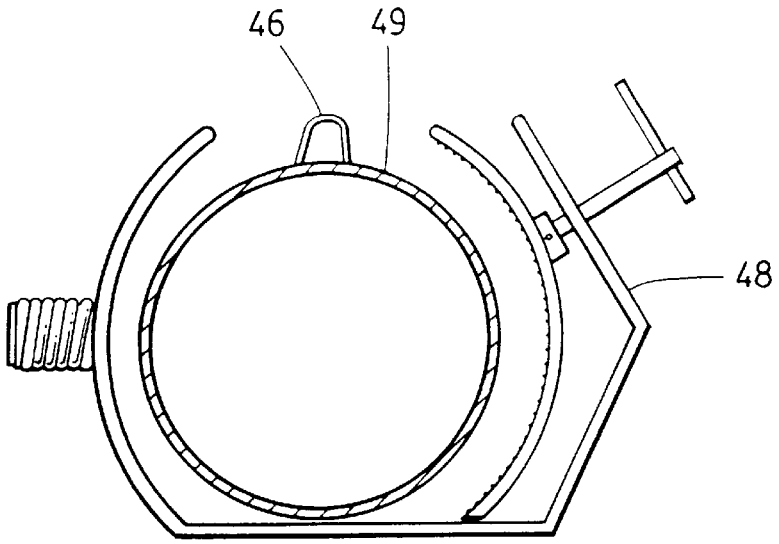
FIG. 7 is a top view of an alternative embodiment of the clamping means.

FIG. 7 is a top view of an alternative embodiment of the clamping means for connecting the portable shot target assembly of this invention to a professional hockey net. It is common for the frame of a professional hockey net to have a plurality of steel loops 46 running along its length to which is connected mesh netting. The alternative embodiment shown in FIG. 7 avoids the problems which can be encountered in securing the clamping means to a professional hockey net by providing for an outer bracket 48 which has more of a "V-shape" on the side where the T-screw passes through. In this manner, the clamping means securely grips the frame 49 of the hockey net while avoiding the steel loops.

Figure 8:
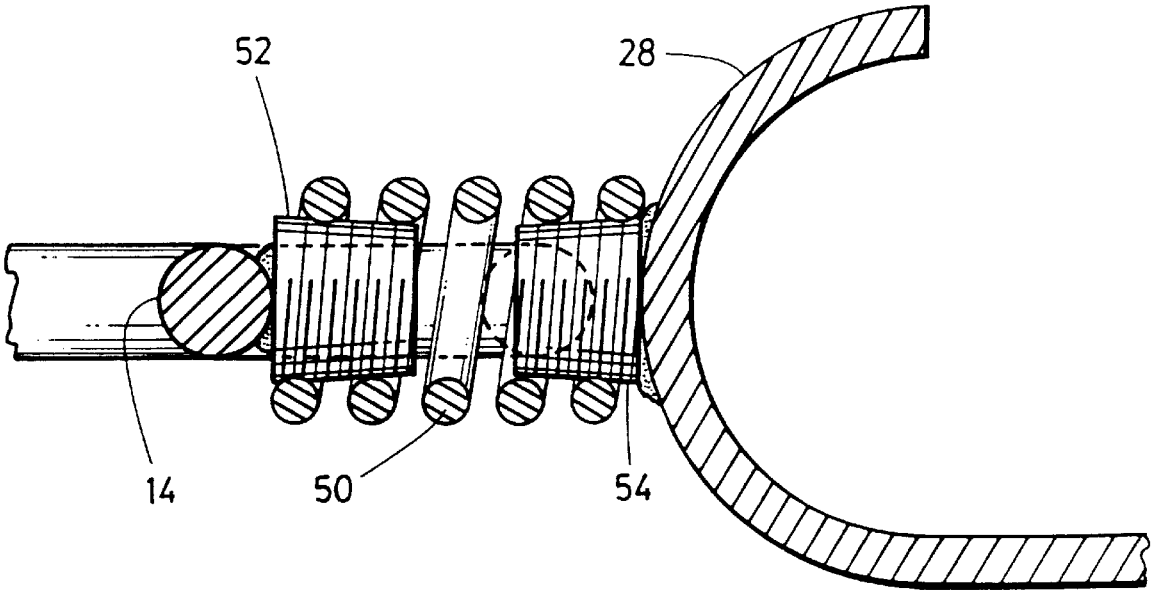
FIG. 8 is a cross-sectional top of the shock absorbing means of the preferred embodiment of the present invention taken along line 8—8 in FIG. 1.

FIG. 8 is a cross-sectional top view of the shock absorbing means of the preferred embodiment taken along line 8—8 in FIG. 1. A spring 50 is, at one end, screwed on to a threaded bolt 52 which is attached to the target 14. The threaded bolt slightly tapers from its point of attachment to the target so that the spring can be tightly secured to the bolt. At its other end, the spring is screwed on to another threaded bolt 54 which is attached to the outer bracket 28 of the clamp. The threaded bolt slightly tapers from its point of attachment to the outer bracket for a secure connection of the spring and bolt. The middle portion of the spring is flexible so as to absorb shock from the impact of a projectile on the target.

The target may be made of steel or any other material so long as it is durable and can withstand both cold temperatures and the impact of a hard object such as a hockey puck travelling at speeds of up to 150 km/hr. Although the targets shown in FIGS. 2 and 4 are oval and circular, respectively, the target can be of any desired shape.

The spring is preferably a heavy gauge spring made of steel or a metal alloy. When used in the sport of hockey, the spring must be strong enough to absorb the impact of a hard object such as a hockey puck travelling at speeds of up to 150 km/hr striking the target such that the target will return to its original position shortly after impact and the spring will retain its shape. Other types of springs may be suitable for other sports.

Although the use of the present invention has been described herein in association with a hockey net, the invention can be connected to a wide variety of fixed objects aside from the goal post or crossbar of a hockey net. For example, the shot target assembly of the present invention could be connected to a vertical bar which has been inserted into the ground. The invention can also be used to practice a wide variety of sports. For example, using a larger target than one would use when practicing hockey, a person could kick a soccer ball at a target which is connected either to the frame of a soccer net or to another fixed object. Using a target of an appropriate size, a person could throw a baseball at a target of the present invention which is connected to a fixed object.

Although only two embodiments of the present invention have been described and illustrated, the present invention is not limited to the features of these embodiments, but includes all variations and modifications within the spirit and scope of the claims.

The embodiments of the invention in which an exclusive property or privilege is claimed are defined as follows:

1. A portable shot target assembly, comprising:

a target;

clamping means for releasably connecting the target to a fixed object; and spring means for absorbing shock from impact on the target, the clamping means comprising, (a) an outer bracket for fitting around a first part of the fixed object, (b) an inner bracket selectively movable relative the outer bracket between a gripping position, where the outer and inner brackets are spaced towards each other to grip the fixed object, and a release position, where the outer and inner brackets are spaced apart to permit removal of the shot target assembly from the fixed object, (c) a bolt head extending from the inner bracket, (d) means for selectively moving the inner and outer brackets relative to each other, wherein the means for selectively moving the inner and outer brackets includes a hand tightened screw which passes through the outer bracket and engages the inner bracket at the bolt head, and whereby the selective rotation of the screw urges the inner bracket from the release to the gripping positions, and a flexible insert for disposition interposed between the outer and inner brackets and the fixed object.

2. The shot target assembly of claim 1, wherein the spring means comprises a spring connected at one end to the target.

3. The shot target assembly of claim 1, wherein the target is defined by a closed band of rigid material.

4. The shot target assembly of claim 3, wherein the closed band is metal.

5. The shot target assembly of claim 4, wherein the metal is steel.

6. The shot target assembly of claim 1, further comprising a pocket for catching a projectile.

7. The shot target assembly of claim 6, wherein the pocket is connected to the target.

8. The shot target assembly of claim 7, wherein the pocket is connected to the perimeter of the target.

9. The shot target assembly of claim 3, wherein a pocket is connected to the closed band.

10. The shot target assembly of claim 2, wherein the target is defined by a closed band of steel.

11. The shot target assembly of claim 10, wherein a pocket is connected to the closed band of the target.

12. The shot target assembly of claim 1, wherein the spring means comprises a spring connected at one end to the target and connected at its other end to the outer bracket.

13. The shot target assembly of claim 12, wherein a threaded member extends from the target and slightly tapers away from the target for threadably receiving one end of the spring and a second threaded member extends from the outer bracket and slightly tapers away from the outer bracket for threadably receiving the opposite end of the spring.

14. The shot target assembly of claim 12, wherein a bolt extends from the target and slightly tapers away from the target for threadably receiving one end of the spring and a bolt extends from the outer bracket and slightly tapers away from the outer bracket for threadably receiving the opposite end of the spring.

15. The shot target assembly of claim 13, wherein the target is defined by a closed band of rigid material.

16. The shot target assembly as claimed in claim 1 further comprising means for coupling the hand-tightened screw to the bolt head.

17. The shot target assembly as claimed in claim 1 wherein the inner bracket includes grooves for gripping the fixed object.

18. The shot target assembly as claimed in claim 11 further comprising means for coupling the hand-tightened screw to the bolt head.

19. A shot target assembly, comprising:

(a) a target defined by a closed band of steel;

(b) a pocket connected to the closed band of steel of the target;

(c) a spring for absorbing shock from impact on the target;

(d) a bolt extending from the target and tapering away from the target for threadably receiving one end of the spring;

(e) a device for clamping the target to a fixed object having:

(i) an outer bracket for fitting around the fixed object;

(ii) an inner bracket, having grooves on its inner surface, for gripping the fixed object;

(iii) a flexible insert for insertion about the fixed object;

(iv) a bolt head extending from the outer surface of the inner bracket;

(v) a hand-tightened screw which passes through the outer bracket and into the upper surface of the bolt head;

(v) a set screw inserted in a side surface of the bolt head for preventing the hand-tightened screw from becoming dislodged from the bolt head; and (f) a bolt extending from the outer bracket and tapering away from the outer bracket for threadably receiving the opposite end of the spring.

20. A shot target assembly, comprising:

(a) a target defined by a closed band of steel;

(b) a pocket connected to the closed band of steel of the target;

(c) a spring for absorbing shock from impact on the target;

(d) a device for clamping the target to a fixed object having:

(i) an outer bracket for fitting around the fixed object;

(ii) an inner bracket, having grooves on its inner surface, for gripping the fixed object;

(iii) a bolt head extending from the outer surface of the inner bracket;

(iv) a hand-tightened screw which passes through the outer bracket and into the upper surface of the bolt head; and (v) a set screw inserted in a side surface of the bolt head for preventing the hand-tightened screw from becoming dislodged from the bolt head;

(e) a bolt extending from the outer bracket and tapering away, from the outer bracket for threadably receiving the opposite end of the spring.

21. The shot assembly of claim 20 further comprising a flexible insert for insertion about the fixed object, wherein in the gripping position the outer and inner brackets engage the flexible insert to retain the target assembly on the fixed object.

* * * * *